US008661590B2

(12) United States Patent
Chen

(10) Patent No.: US 8,661,590 B2
(45) Date of Patent: Mar. 4, 2014

(54) AIR MATTRESS

(75) Inventor: Yuan-Chen Chen, Taoyuan County (TW)

(73) Assignee: Apex Billion Int'l Inv. Ltd., Taipei (TW)

( * ) Notice: Subject to any disclaimer, the term of this patent is extended or adjusted under 35 U.S.C. 154(b) by 0 days.

(21) Appl. No.: 13/541,760

(22) Filed: Jul. 4, 2012

(65) Prior Publication Data

US 2013/0145560 A1 Jun. 13, 2013

Related U.S. Application Data

(60) Provisional application No. 61/570,255, filed on Dec. 13, 2011.

(51) Int. Cl.
*A47C 27/08* (2006.01)

(52) U.S. Cl.
USPC ..... 5/711; 5/710

(58) Field of Classification Search
USPC ..... 5/706, 655.3, 710–713
See application file for complete search history.

(56) References Cited

U.S. PATENT DOCUMENTS

| | | | | |
|---|---|---|---|---|
| D335,999 | S * | 6/1993 | Van Driessche | D6/604 |
| 5,490,295 | A | 2/1996 | Boyd | |
| 5,594,964 | A | 1/1997 | Boyd et al. | |
| 6,983,502 | B2 | 1/2006 | Boyd | |
| 7,152,264 | B2 | 12/2006 | Boyd | |
| 7,353,555 | B2 * | 4/2008 | Lau | 5/711 |
| 7,367,073 | B2 | 5/2008 | Boyd | |
| 7,380,300 | B2 | 6/2008 | Boyd | |
| 7,610,642 | B2 | 11/2009 | Boyd | |
| 2002/0083528 | A1 * | 7/2002 | Fisher et al. | 5/706 |

* cited by examiner

*Primary Examiner* — Frederick Conley
(74) *Attorney, Agent, or Firm* — Jiang Chyun IP Office

(57) ABSTRACT

An air mattress including an inflatable compartment, strips, a connecting sheet and pillow strips is provided. The inflatable compartment includes a top wall, a bottom wall and a side wall surrounding peripheries of the top wall and the bottom wall. The strips are air-pervious and disposed in the inflatable compartment, wherein the strips are connected between the bottom wall and the top wall and located in a lying portion of the top wall. The connecting sheet is air-pervious and disposed in the inflatable compartment and facing a pillow portion of the top wall, wherein the connecting sheet is connected between the side wall and the strips adjacent to the pillow portion. The pillow strips are air-pervious and disposed in the inflatable compartment, wherein the pillow strips are connected between the connecting sheet and the pillow portion of the top wall.

20 Claims, 10 Drawing Sheets

AIR MATTRESS

CROSS-REFERENCE TO RELATED APPLICATION

This application claims the priority benefit of U.S. provisional application Ser. No. 61/570,255, filed Dec. 13, 2011. The entirety of the above-mentioned patent application is hereby incorporated by reference herein and made a part of this specification.

BACKGROUND OF THE INVENTION

1. Field of Invention

The present invention generally relates to an air mattress, and more particularly, to an air mattress has a pillow strips to provide pillow portion.

2. Description of Related Art

Conventional air mattresses (air beds) are convenient to carry outdoor, since users can use them to take a rest and before use just inflating the air mattress is needed. Air mattresses generally include strips so as to stretch the inner walls of the air mattresses after inflated.

The aforementioned air mattresses are only single-layered structures. If the air mattress needs to increase an extra layer structure, the conventional method is to assemble two single-layered air mattresses to form a two-layered structure. However, this assembling method would become inefficient if air mattresses having more than two layers are required. Or even if they are assembled, individually inflating each of the air mattresses is necessary and causes great inconvenience. In addition, after conventional the air mattresses are inflated, users need to specially prepare pillows since there is no pillow formed on the top wall of the air mattress, and it may also cause great inconvenience.

SUMMARY OF THE INVENTION

The present invention provides an air mattress having pillow strips for increasing comfort.

An exemplary embodiment of the present invention provides an air mattress including an inflatable compartment, strips, a connecting sheet and pillow strips. The inflatable compartment includes a top wall, a bottom wall and a side wall surrounding peripheries of the top wall and the bottom wall. The strips are air-pervious and disposed in the inflatable compartment, wherein the strips are connected between the bottom wall and a lying portion of the top wall. The connecting sheet is air-pervious and disposed in the inflatable compartment and facing a pillow portion of the top wall, wherein the connecting sheet is connected between the side wall and the strips adjacent to the pillow portion. The pillow strips are air-pervious and disposed in the inflatable compartment, wherein the pillow strips are connected between the connecting sheet and the pillow portion of the top wall.

An exemplary embodiment of the present invention provides an air mattress including an inflatable compartment, strips, a peripheral strip and pillow strips. The inflatable compartment includes a top wall, a bottom wall and a side wall surrounding peripheries of the top wall and the bottom wall. The top wall includes a pillow portion and a lying portion. The strips are air-pervious and disposed in the inflatable compartment, wherein the strips are connected between the bottom wall and a lying portion of the top wall. The peripheral strip is air-pervious and disposed in the inflatable compartment. The peripheral strip surrounds the strips and connected between the side wall and the top wall, so that the side wall is formed into a first layer portion and a second layer portion. The pillow strips are air-pervious and disposed in the inflatable compartment, wherein the pillow strips are connected between the peripheral strip and the pillow portion of the top wall.

According to an exemplary embodiment of the present invention, a height of the side wall adjacent to the pillow portion of the top wall is greater than a height of the side wall adjacent to the lying portion of the top wall.

According to an exemplary embodiment of the present invention, a top end and a bottom end of each of the strips are respectively connected to the top wall and the bottom wall, a length of the top end is greater than a length of the bottom end, and each of the strips has a recess at each side.

According to an exemplary embodiment of the present invention, the peripheral strip has a recess at each side.

According to an exemplary embodiment of the present invention, the air mattress further includes an inflating device. The inflating device is disposed on the side wall.

An exemplary embodiment of the present invention provides an air mattress including an inflatable compartment, strips, a first peripheral strip, a second peripheral strip and pillow strips. The inflatable compartment includes a top wall, a bottom wall and a side wall surrounding peripheries of the top wall and the bottom wall. The top wall includes a pillow portion and a lying portion. The strips are air-pervious and disposed in the inflatable compartment, wherein the strips are connected between the bottom wall and the lying portion of the top wall. The first peripheral strip and the second peripheral strip are air-pervious and disposed in the inflatable compartment. The first peripheral strip surrounds the strips and connected between the side wall and the top wall, and peripheral strip surrounds the strips and connected between the side wall and the bottom wall, so that the side wall is formed into a first layer portion, a second layer portion and a third layer portion. The pillow strips are air-pervious and disposed in the inflatable compartment, wherein the pillow strips are connected between the first peripheral strip, the second peripheral strip and the pillow portion of the top wall.

According to an exemplary embodiment of the present invention, a height of the side wall adjacent to the pillow portion of the top wall is greater than a height of the side wall adjacent to the lying portion of the top wall.

According to an exemplary embodiment of the present invention, a top end and a bottom end of each of the strips are respectively connected to the top wall and the bottom wall, and a length of the top end is greater than a length of the bottom end, and each of the strips has a recess at each side.

According to an exemplary embodiment of the present invention, each of the pillow strips has a recess at each side.

According to an exemplary embodiment of the present invention, the air mattress further includes an inflating device. The inflating device is disposed on the side wall.

According to an exemplary embodiment of the present invention, the air mattress further includes a peripheral strip. The peripheral strip is air-pervious, disposed in the inflatable compartment and surrounds the strips and connected between the bottom wall and the side wall, so that the side wall is formed into a first layer portion and a second layer portion.

According to an exemplary embodiment of the present invention, the air mattress further includes a first peripheral strip and a second peripheral strip. The first peripheral strip and the second peripheral strip are air-pervious, disposed in the inflatable compartment and surround the strips and respectively connected between the bottom wall and the side wall, so that the side wall is formed into a first layer portion, a second layer portion and a third layer portion.

According to an exemplary embodiment of the present invention, a height of the side wall adjacent to the pillow portion of the top wall is greater than a height of the side wall adjacent to the lying portion of the top wall.

According to an exemplary embodiment of the present invention, a top end and a bottom end of each of the strips are respectively connected to the top wall and the bottom wall, and a length of the top end is greater than a length of the bottom end, and each of the strips has a recess at each side.

According to an exemplary embodiment of the present invention, the connecting sheet has a recess at each side, and each of the pillow strips has a recess at each side.

According to an exemplary embodiment of the present invention, the peripheral strip has a dragging portion and a reserved portion extending from the upper end of the dragging portion. The upper end and the lower end of the dragging portion are respectively connected to the side wall and the bottom wall, and a portion of the reserved portion is connected to the connecting sheet.

According to an exemplary embodiment of the present invention, the first peripheral strip has a dragging portion and a reserved portion extending from the upper end of the dragging portion. The upper end and the lower end of the dragging portion are respectively connected to the side wall and the bottom wall, and at least a portion of the reserved portion is connected to the connecting sheet.

According to an exemplary embodiment of the present invention, the air mattress further includes a reinforcing sheet. The reinforcing sheet is disposed on the strip adjacent to the pillow portion and connected to the connecting sheet.

According to an exemplary embodiment of the present invention, the air mattress further includes an inflating device. The inflating device is disposed on the side wall.

In light of the above, comfort and convenience of the air mattress of the embodiment of present invention is increased because of the design of inner structure of pillow portion of the air mattress, wherein the top wall of the air mattress is formed with a lying portion and a pillow portion protruded from the lying portion due to the side wall designed with different heights. Accordingly, the user can pillow on the pillow portion of the top wall when lying on the air mattress and does not need to prepare any other pillow or something having pillow function. Furthermore, since pillow strips are added in the pillow portion, the surface of the pillow portion of the air mattress is comparatively smooth and it increases great comfort to the user.

In order to make the aforementioned and other features and advantages of the present invention more comprehensible, several embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
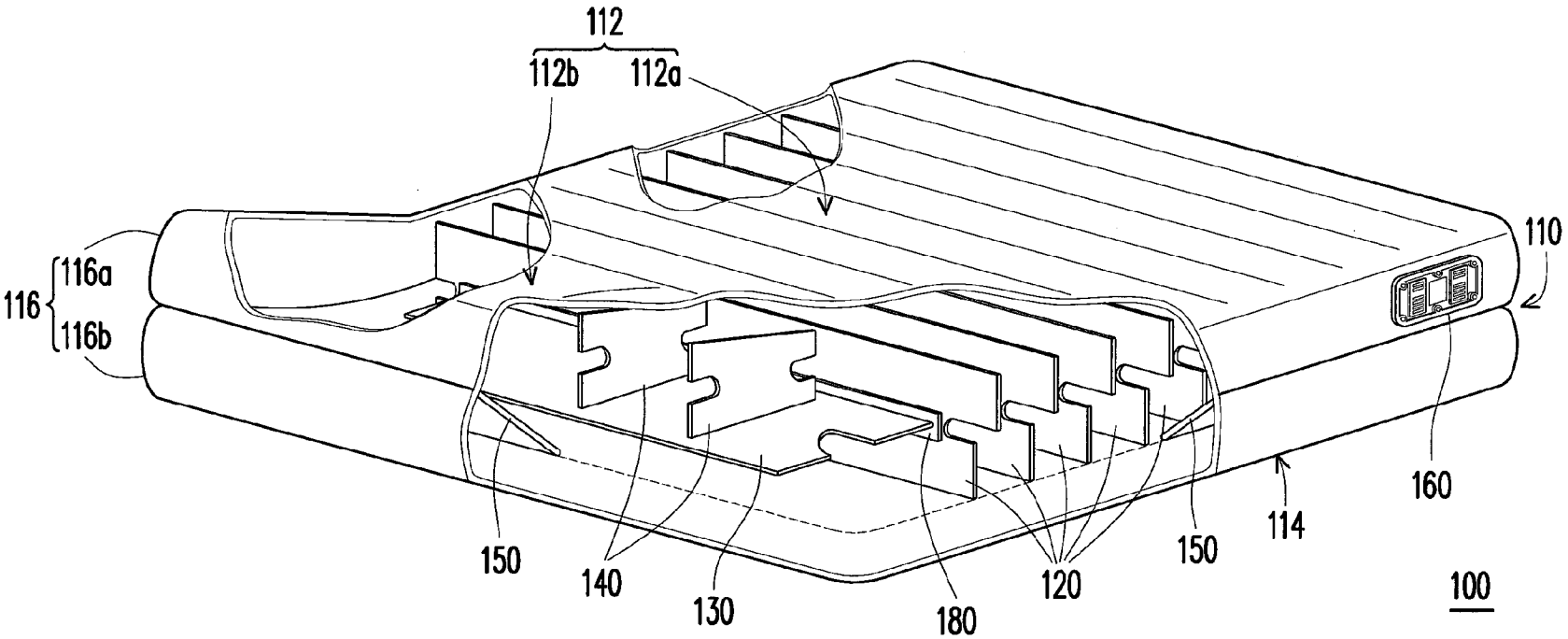
FIG. 1 is a perspective view of an air mattress according to an exemplary embodiment of the present invention.
Figure 2:
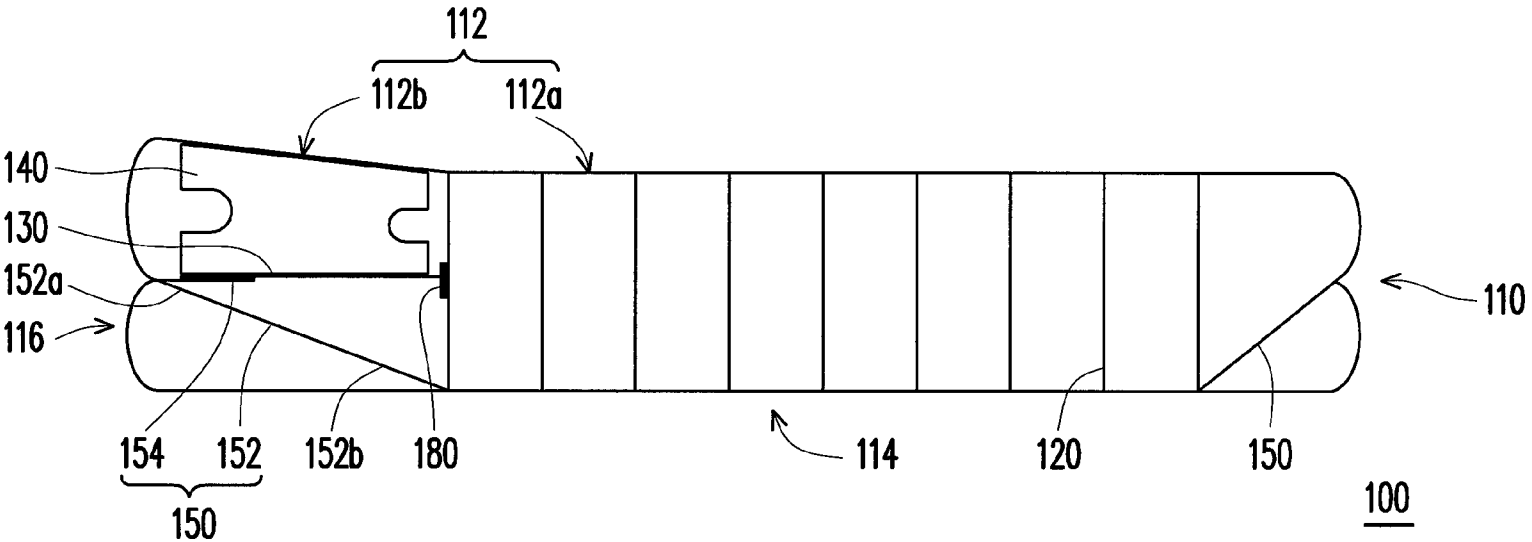
FIG. 2 is a schematic cross-sectional view along the length direction of the air mattress of FIG. 1.

FIG. 1 is a perspective view of an air mattress according to an exemplary embodiment of the present invention. FIG. 2 is a schematic cross-sectional view along the longitudinal direction of the air mattress of FIG. 1. Referring to FIG. 1 and FIG. 2, in the embodiment, the air mattress 100 includes an inflatable compartment 110, strips 120, a connecting sheet 130 and pillow strips 140. The inflatable compartment 110 is formed by a top wall 112, a bottom wall 114 and a side wall 116 surrounding thereto, wherein the side wall 116 surrounds the peripheries of the top wall 112 and the bottom wall 114. In the embodiment, the strips 120, the connecting sheet 130 and the pillow strips 140 are disposed in the inflatable compartment 110. The strips 120 are arranged substantially parallel to the width direction of the air mattress 100 and respectively connected between the bottom wall 114 and the lying portion 112*a* of the top wall 112.

Specifically, in order to form the comparatively higher pillow portion on the air mattress 100, the side wall 116 (referring to FIG. 5A) of the embodiment is designed to have regions with different heights. Thus, when the side wall 116 and the top wall 112 are jointed to each other, the middle protruding region of the side wall 116 may provide the top wall 112 a larger inflated space, so as to form the pillow portion 112*b*, wherein the height H2 of the side wall 116 adjacent to the pillow portion 112*b* is greater than the height H1 of the side wall 116 adjacent to the lying portion 112*a*.

In such configuration, due to the different heights of the side wall 116, the lying portion 112*a* and the pillow portion 112*b* protruded from the lying portion 112*a* can be formed on the top wall 112 of the air mattress 100. Accordingly, the user can pillow on the pillow portion 112*b* of the top wall 112 when lying on the air mattress 100 and does not need to prepare any other pillow or something having pillow function. However, when the inflatable compartment 110 of the air mattress 100 is inflated and if the pillow portion 112*b* is not fixed by using specific structures in the inflatable compartment 110, the surface of the pillow portion 112*b* may be too inflated to be stable and it may further cause inconvenience for users to lie thereon.

In the embodiment, the pillow strips 140 and the connecting sheet 130 are used so that the surface of the pillow portion 112*b* of the air mattress 100 may comparatively be leveled and the comfort can be increased. It is further described with examples in the following.

The connecting sheet 130 faces the pillow portion 112*b* of the top wall 112 and connected between the side wall 116 and the strip 120 nearest to the pillow portion 112*b*. Moreover, the strips 140 are arranged substantially parallel to the length direction of the air mattress 100 and respectively connected between the pillow portion 112*b* of the top wall 112 and the connecting sheet 130. Therefore, through the design of the pillow strips 140 and the connecting sheet 130, the pillow portion 112*b* may not be too inflated, thus the surface of the pillow portion 112*b* may relatively be more stable and the comfort of the air mattress 100 can be greatly improved.

In addition, each of the strips 120 (referring to FIG. 5B), the connecting sheet 130 (referring to FIG. 5C) and the pillow strips 140 (referring to FIG. 5D) has a recess 122, 132, 142 at each side. Therefore, the air within the inflatable compartment 110 may pass through among the recesses 122, 132, 142, the two not jointed sides of the strips 120, the two not jointed sides of the connecting sheet 130 and the two not jointed sides of the pillow strips 140, so that the strips 120, the connecting sheet 130 and the pillow strips 140 are air-pervious. Accordingly, the air within the inflatable compartment 110 can flow and no air-flow prevention is caused within the inflatable compartment 110.

In addition, the inflatable compartment 110 is made by an air-impermeable material, for example a plastic material such as polyvinyl. Thus, after the inflatable compartment 110 of the air mattress 100 is inflated, the air cannot leak out and is maintained within the inflatable compartment 110. In addition, the strips 120, the connecting sheet 130, the pillow strips 140 and other components may be made by the aforementioned polyvinyl or other materials.

Figure 3:
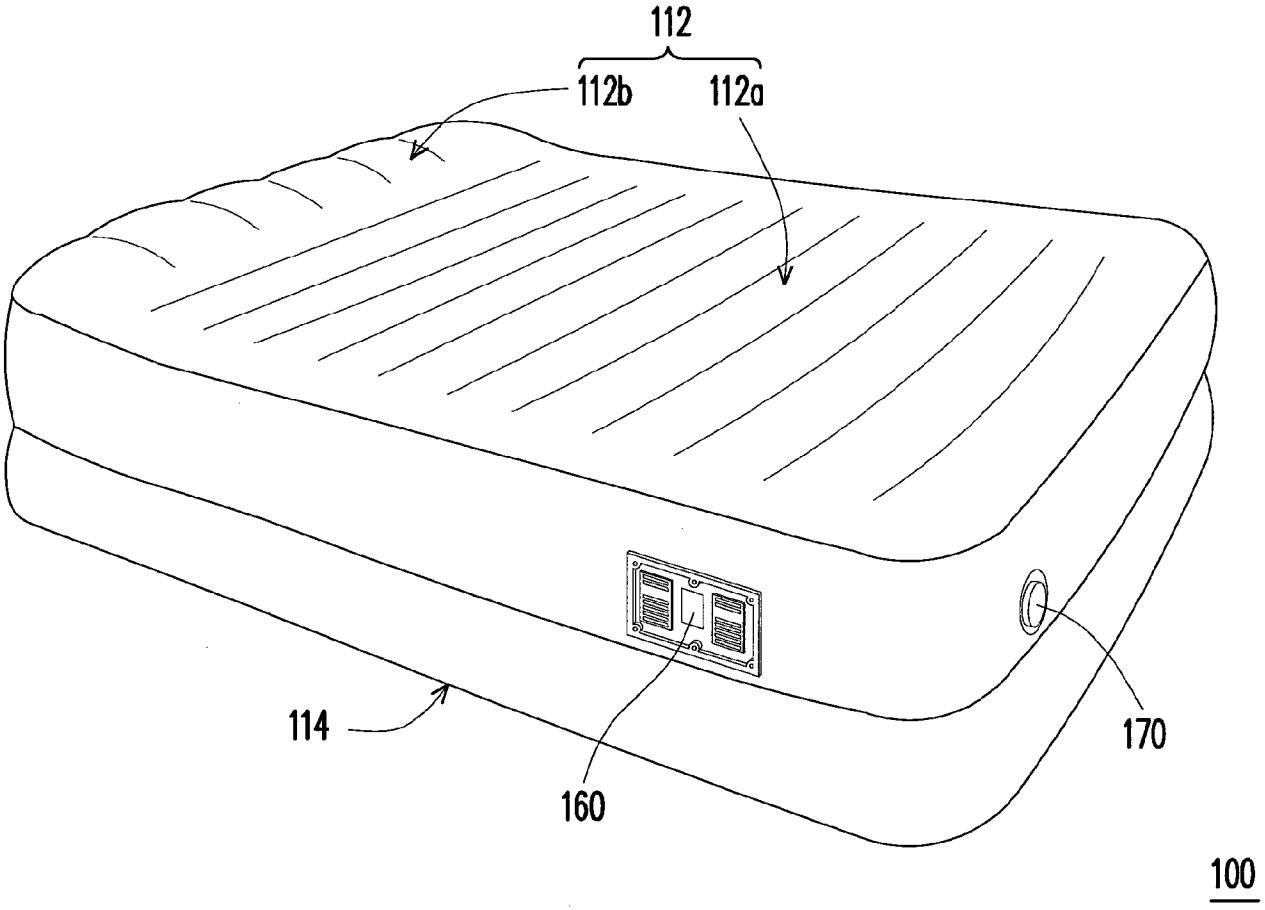
FIG. 3 is a perspective view of the air mattress of FIG. 1 in another viewing angle.

FIG. 3 is a perspective view of the air mattress of FIG. 1 in another viewing angle. In the embodiment, the air mattress 100 further includes an inflating device 160 and a deflating valve 170 respectively disposed on the side wall 116. Accordingly, the air mattress 100 can be inflated through the inflating device 160. On the other hand, the air of the inflatable compartment 110 of the air mattress 100 can be deflated through the deflating valve 170, when the air mattress 100 is not used. In other embodiments, inflating device and/or deflating valve can be disposed on the side wall 116 of the air mattress 100 as required.

Figure 4:
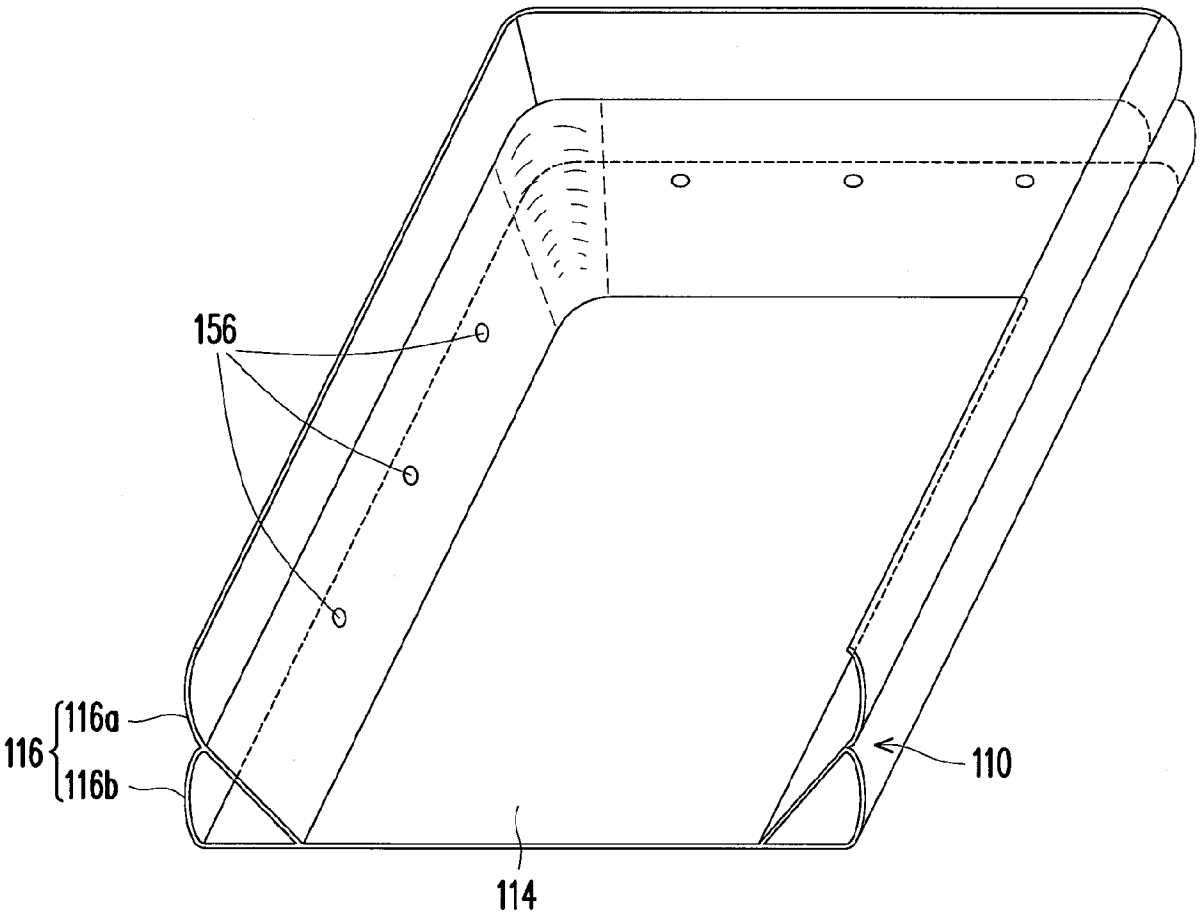
FIG. 4 schematically shows a perspective view of a portion of the air mattress of FIG. 1.

FIG. 4 schematically shows a perspective view of a portion of the air mattress of FIG. 1. Herein the top wall 112, the strips 120, the connecting sheet 130 and the pillow strips 140 of FIG. 1 and FIG. 2 are omitted in FIG. 4, in order to clearly illustrate the corresponding relation between the components. Referring to FIG. 2 and FIG. 4, in the embodiment, the air mattress 100 further includes four peripheral strips 150 respectively disposed in the inflatable compartment 110. Each of the peripheral strips 150 is incliningly connected between the bottom wall 114 and the side wall 116, and the peripheral strips 150 are connected to each other and surround the strips 120. In other embodiments, the quantity of the peripheral strips 150 may be other suitable number and the peripheral strips are connected to each other and surround the strips 120, or only one integrated peripheral strip 150 may surround the strips 120, but the present invention is not limited thereto. On the other hand, another end of each of the peripheral strips 150 is connected to the corresponding side wall 116, so that the side wall 116 is formed into a first layer portion 116*a* and a second layer portion 116*b*. In other words, through the peripheral strips 150, the user can obtain the side wall 116 with a double-layered structure and no need to stack an extra mattress onto the air mattress 100.

More specifically, as shown in FIG. 2, each of the peripheral strips 150 has a dragging portion 152 and a reserved portion 154 extending from the upper end 152*a* of the dragging portion 152. The upper end 152*a* of the dragging portion 152 and the lower end 152*b* of the dragging portion 152 are connected to the side wall 116 and the bottom wall 114, respectively. At least a portion of the reserved portion 154 is connected to the connecting sheet 130. The method of the reserved portion 154 connecting to the connecting sheet 130 is not limited in the present invention, for example by adhesive bonding method or thermal welding method. For example, the reserved portion 154 is connected to the connecting sheet 130 by using the thermal welding method so that the connection can be more stable. Thus, the connection between the reserved portion 154 and the connecting sheet 130 is hard to break, after the air mattress 100 is inflated.

In the present embodiment, the air mattress 100 further includes a reinforcing sheet 180 (as shown in FIG. 2). The reinforcing sheet 180 is disposed on the strip 120 adjacent to the pillow portion 112*b* and connected to the connecting sheet 130. In the embodiment, the method of the reinforcing sheet 180 connecting to the connecting sheet 130 is not limited in the present invention, for example by adhesive bonding method or thermal welding method. For example, the reinforcing sheet 180 is connected to the connecting sheet 130 by using the thermal welding method so that the connection can be more stable. Thus, the connection between the reinforcing sheet 180 and the connecting sheet 130 is hard to break, after the air mattress 100 is inflated.

Figure 5A:
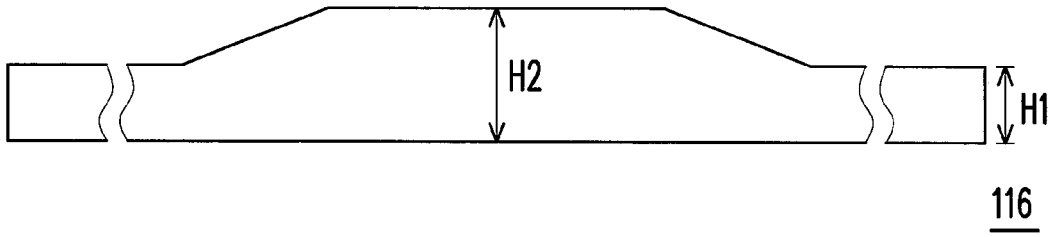
FIG. 5A shows the expanded view of the side wall of FIG. 1.
Figure 5B:
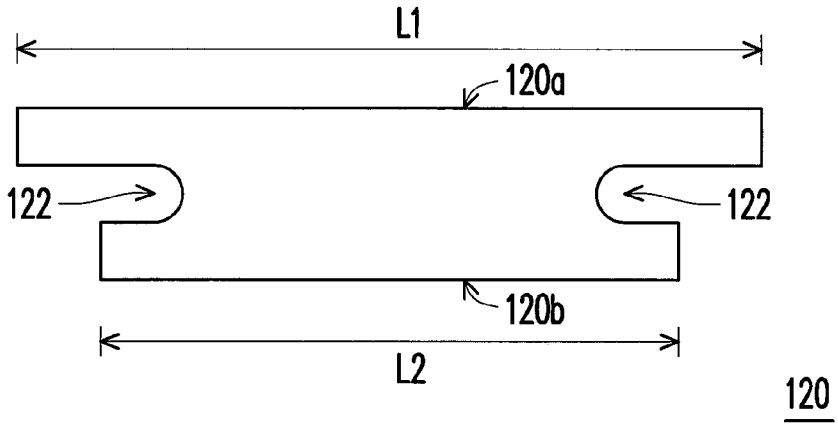
FIG. 5B shows the expanded view of a strip of FIG. 1.
Figure 5C:
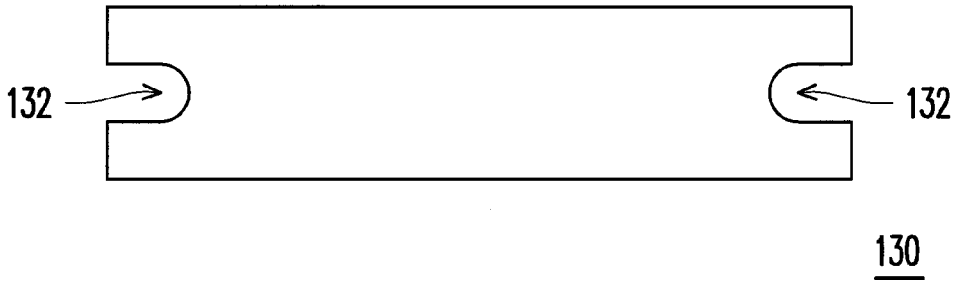
FIG. 5C shows the expanded view of the connecting sheet of FIG. 1.
Figure 5D:
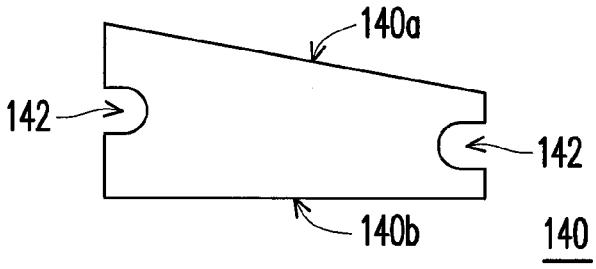
FIG. 5D shows the expanded view of a pillow strip of FIG. 1.
Figure 5E:
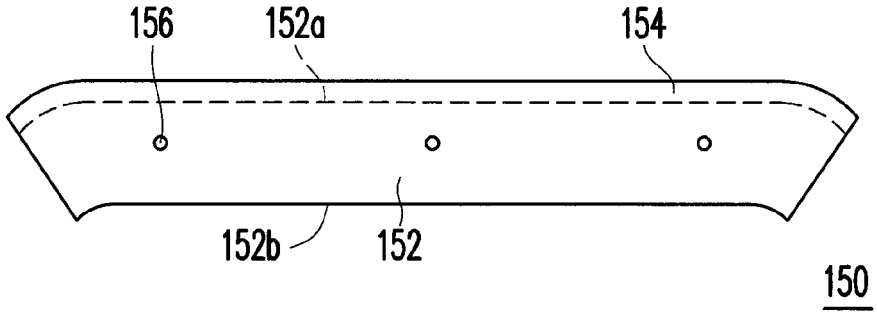
FIG. 5E shows the expanded view of a peripheral strip of FIG. 1.

The shapes of the aforementioned side wall 116, the strip 120, the connecting sheet 130, the pillow strips 140 and the peripheral strips 150 are not limited in the present invention and described accompanying with figures in the following. FIG. 5A shows the expanded view of the side wall of FIG. 1. FIG. 5B shows the expanded view of a strip of FIG. 1. FIG. 5C shows the expanded view of the connecting sheet of FIG. 1. FIG. 5D shows the expanded view of a pillow strip of FIG. 1. FIG. 5E shows the expanded view of a peripheral strip of FIG. 1. Referring to FIG. 5A, FIG. 1, FIG. 2 and FIG. 3, in the embodiment, the height H2 of the side wall 116 of the adjacent to the pillow portion 112*b* is greater than the height H1 of the side wall 116 adjacent to the lying portion 112*a*.

Next, referring to FIG. 5B, FIG. 1 and FIG. 2, the upper edge 120*a* of each of the strips 120 and the lower edge 120*b* of each of the strips 120 are connected to the top wall 112 and the bottom wall 114, respectively. Each of the strips 120 has a recess 122 substantially in a half-circle shape at each side. In the embodiment, the length L1 of the upper edge 120*a* of each of the strips 120 is greater than the length L2 of the lower edge 120*b* of each of the strips 120. Thus, after the lower edge 120*b* of each of the strips is connected to the bottom wall 114, some extra space may still be left for the peripheral strip 150 to surround thereon. In addition, each of the strips 120 is connected between the top wall 112 and the bottom wall 114, and after the air mattress 100 is inflated, the recesses 122 formed at two sides of each strip 120 may buff the tensile force of the top wall 112 and the bottom wall 114 exerting on the strips 120. Thus, after the inflatable compartment 110 of the air mattress 100 is inflated, the design of the recesses 122 disposed on two sides of each of the strips 120 may greatly prevent the strips 120 connected between the edges 120*a*, 120*b* of the top wall 112 and the bottom wall 114 from being extracted from the top wall 112 and the bottom wall 114 connected therebetween or the strips 120 from being broken.

Referring to FIG. 5C, FIG. 1 and FIG, 2 together, in the embodiment, the connecting sheet 130 has a substantially-half-circle shaped recess 132 at each side. After the air mattress 100 is inflated, the recesses 132 of the connecting sheet 130 may buff the tensile force of the side wall 116 and adjacent the strips 120 exerting thereon. Thus, after the inflatable compartment 110 of the air mattress 100 is inflated, the design of the recesses 132 disposed on two sides of the connecting sheet 130 may greatly prevent the connecting sheet 130 from being extracted from the side wall 116 and/or the strips 120 connected therebetween or the connecting sheet 130 from being broken. Similarly, as shown in FIG. 5D, the recesses 142 of the pillow strips 140 may buff the tensile force of the pillow portion 112*b* and the connecting sheet 130 exerting on the pillow strips 140. Thus, after the inflatable compartment 110 of the air mattress 100 is inflated, the design of the recesses 142 disposed on two sides of each of the pillow strips 140 may greatly prevent the pillow strips 140 from being extracted from the pillow portion 112*b* and the connecting sheet 130 connected therebetween or the pillow strips 140 from being broken. In addition, the length direction of the edge 140*a* of each of the pillow strips 140 is tilted to the length direction of another edge 140*b* of each of the pillow strips 140.

Referring to FIG. 5E, FIG. 1 and FIG. 2, the peripheral strip 150 has a plurality of through holes 156. Therefore, the air within the inflatable compartment 110 may flow through the through holes 156, so that the peripheral strip 150 is air-pervious and may not cause the air-flow prevention within the inflatable compartment 110. However, besides the through holes 156 may not cause air-flow prevention within the inflating compartment 110, the through holes 156 may also provide damping to the peripheral strip 150 from being exerted by tensile force of the bottom wall 114 and the side wall 116. Thus, after the inflatable compartment 110 of the air mattress 100 is inflated, the design of the through holes 156 may greatly prevent the peripheral strip 150 from being extracted from the bottom wall 114 and/or the side wall 116 connected therebetween or the peripheral strip 150 from being broken.

Figure 6:
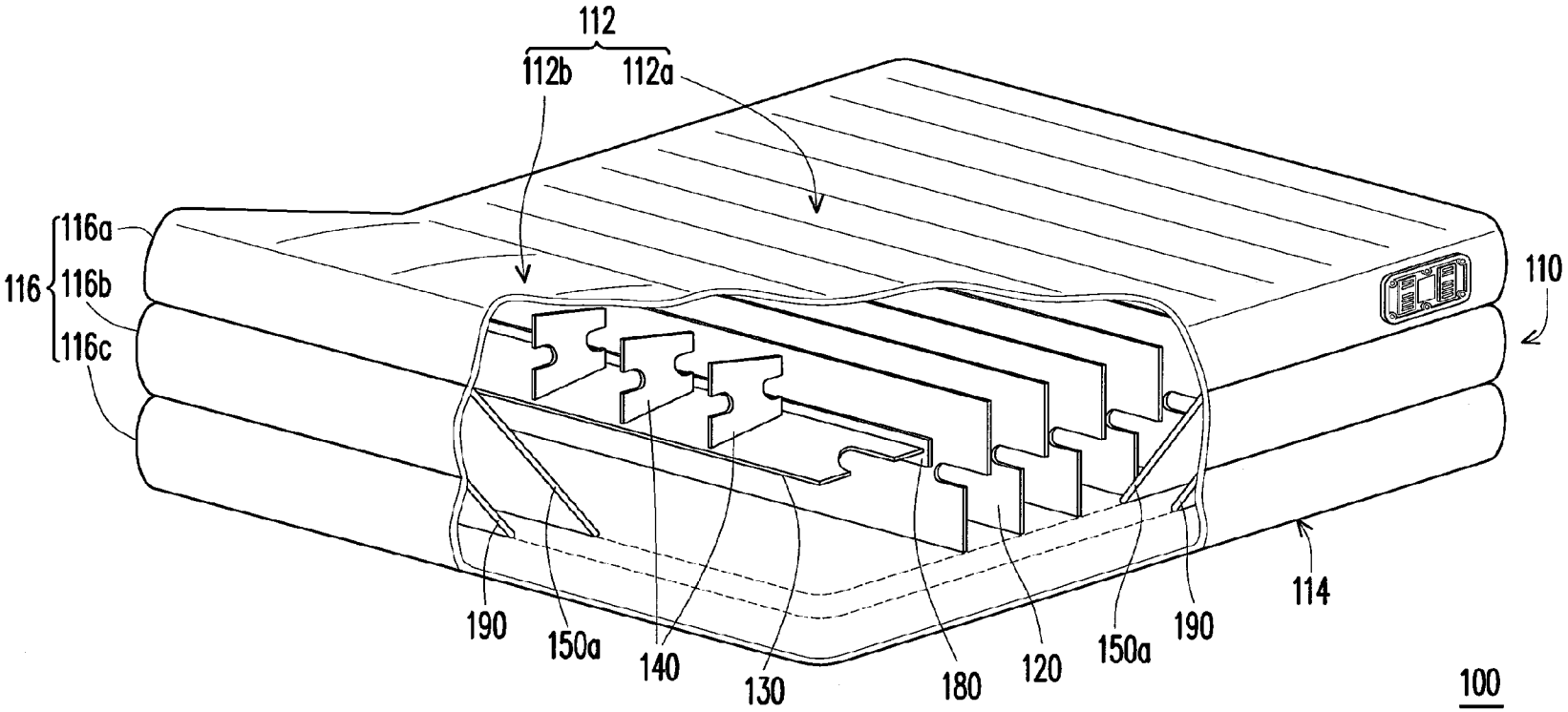
FIG. 6 is a perspective view of an air mattress according to another exemplary embodiment of the present invention.

FIG. 6 is a perspective view of an air mattress according to another exemplary embodiment of the present invention. Referring to FIG. 6, in the air mattress 100 of the embodiment, the strips 120, the connecting sheet 130 and the pillow strips 140 are air-pervious and disposed in the inflatable compartment 110. The strips 120 are arranged substantially parallel to the width direction of the air mattress 100 and respectively connected between the bottom wall 114 and the lying portion 112*a* of the top wall 112. The connecting sheet 130 faces the pillow portion 112*b* of the top wall 112 and connected between the side wall 116 and the strip 120 nearest to the pillow portion 112*b*. The pillow strips 140 are arranged substantially parallel to the length direction of the air mattress 100 and connected between the connecting sheet 130 and the pillow portion 112*b* of the top wall 112.

In the embodiment, the air mattress 100 further includes a first peripheral strip 150*a* and a second peripheral strip 190, wherein the first peripheral strip 150*a* and the second peripheral strip 190 are connected to the side wall 116 and have different heights. The peripheral strips 150*a* are air-pervious disposed in the inflatable compartment 110 and surround the strips 120. The lower ends of the first peripheral strip 150*a* and the second peripheral strip 190 are incliningly connected to the bottom wall 114, and the upper ends are respectively connected to the side wall 116 with different heights, so that the side wall 116 is formed into a first layer portion 116*a*, a second layer portion 116*b* and a third layer portion 116*c*. Thus, through the first peripheral strip 150*a* and the second peripheral strip 190, the air mattress 100 can formed into a side wall 116 with three-layered structure.

The functions and shapes of the reinforcing sheet 180 shown in FIG. 6 and the aforementioned side wall 116, strips 120, connecting sheet 130, pillow strips 140, first peripheral strip 150*a* and second peripheral strip 190 are similar or the same to the functions and shapes of the reinforcing sheet, side wall, strips, connecting sheet, pillow strips and peripheral strip of the air mattress of the aforementioned first embodiment shown in FIG. 1, thus the detailed description of the design can be referred to FIG. 1, FIG. 2, FIG. 3 and FIG. 5A to FIG. 5E, and it is not repeated herein.

The aforementioned first embodiment shown in FIG. 1 and second embodiment shown in FIG. 6, as shown in FIG. 5C, through the connecting sheet 130 disposed horizontally, each of the pillow strips 140 is connected to the pillow portion 112*b* of the top wall 112 and the connecting sheet 130. However, the present invention is not limited thereto, and examples are described accompanying with figures in the following.

Figure 7:
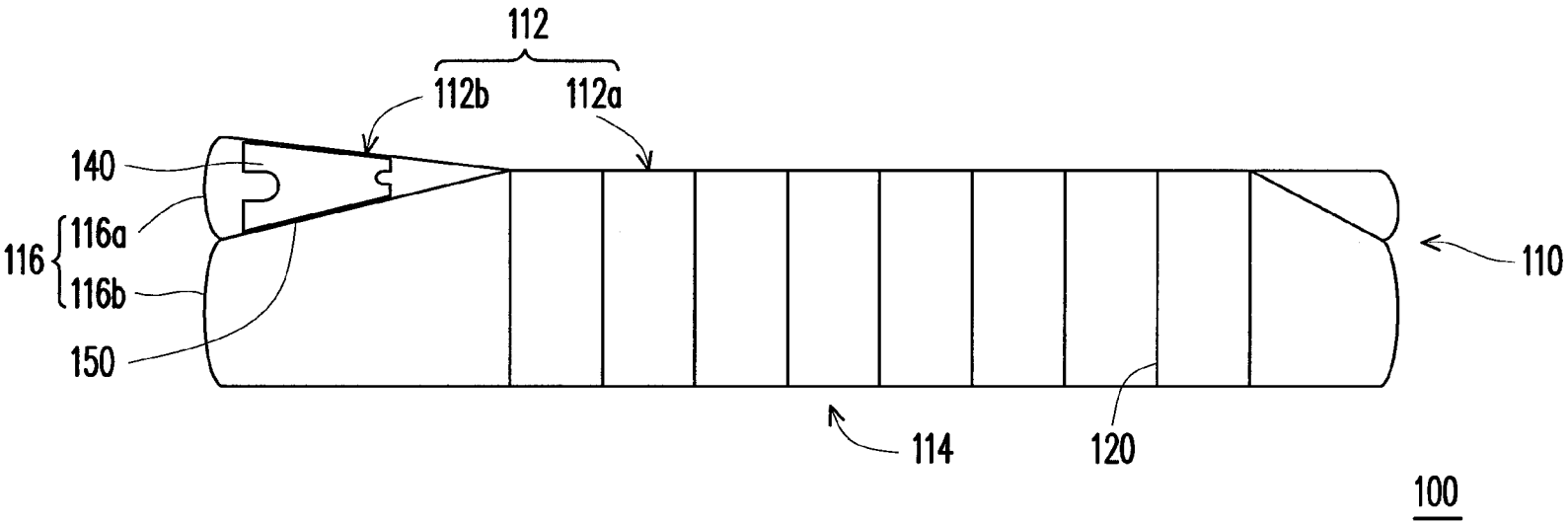
FIG. 7 is a cross-sectional view of an air mattress along the length direction according to another exemplary embodiment of the present invention.

FIG. 7 is a cross-sectional view of an air mattress along the length direction according to another exemplary embodiment of the present invention. Referring to FIG. 7, the air mattress 100 includes an inflatable compartment 110, a plurality of strips 120, a peripheral strip 150 and a plurality of pillow strips 140, wherein the strips 120, the peripheral strip 150 and the pillow strips 140 are air-pervious disposed in the inflatable compartment 110. The inflatable compartment 110 includes a top wall 112, a bottom wall 114 and a side wall 116 surrounding peripheries of the top wall 112 and the bottom wall 114.

As mentioned, the top wall 112 includes a pillow portion 112*b* and a lying portion 112*a*. The strips 120 are arranged substantially parallel to the width direction of the air mattress 100 and respectively connected between the bottom wall 114 and the lying portion 112*a* of the top wall 112. In the embodiment, the peripheral strip 150 surrounds the strips 120 and incliningly connected between the side wall 116 and the top wall 112, so that the side wall 116 is formed into a first layer portion 116*a* and a second layer portion 116*b*. The pillow strips 140 are arranged substantially parallel to the length direction of the air mattress 100 and directly connected between the peripheral strip 150 and the pillow portion 112*b* of the top wall 112.

In the embodiment, as shown in FIG. 7, the air mattress 100 has no connecting sheet disposed therein as the above mentioned embodiments, thus the lower edge of each of the pillow strips 140 are connected to the peripheral strip 150 instead of being connected to the connecting sheet. The air mattress 100 of the embodiment can make the pillow strips 140 fixed without the connecting sheet. In the embodiment, the peripheral strip 150 is incliningly connected between the side wall 116 and the top wall 112, in order that the side wall 116 is formed into two layer portions 116*a* and 116*b*. Accordingly, by such configuration, compared to the above mentioned embodiments, the air mattress 100 of the present embodiment can save the material and manufacturing cost and labor of the connecting sheet and the reinforcing sheet, and the appearance of the air mattress 100 can be more artistic.

No connecting sheet and reinforcing sheet are included in the present embodiment. In addition, the functions and shapes of the side wall 116, strips 120, pillow strips 140, peripheral strip 150 are similar or the same to the functions and shapes of the side wall, strips, pillow strips and peripheral strip of the air mattress of the aforementioned first embodiment (referred to FIG. 1), thus the detailed description of the design can be referred to FIG. 1, FIG. 2, FIG. 3 and FIG. 5A to FIG. 5E, and it is not repeated herein. However, it has to be noted that the height of the pillow strips 140 is smaller located relatively nearer to the connecting location of the peripheral strip 150 and the top wall 112, since the lower edge of each of the strips 140 is directly connected on the peripheral strip 150.

In addition, in the embodiment as shown in FIG. 7 and other embodiments, quantity of the peripheral strip with different heights connected to the side wall is not limited in the present invention. In other words, quantity of the layer structure formed by the side wall is not limited in the air mattress of other embodiments of the present invention, and examples are described accompanying with figures in the following.

Figure 8:
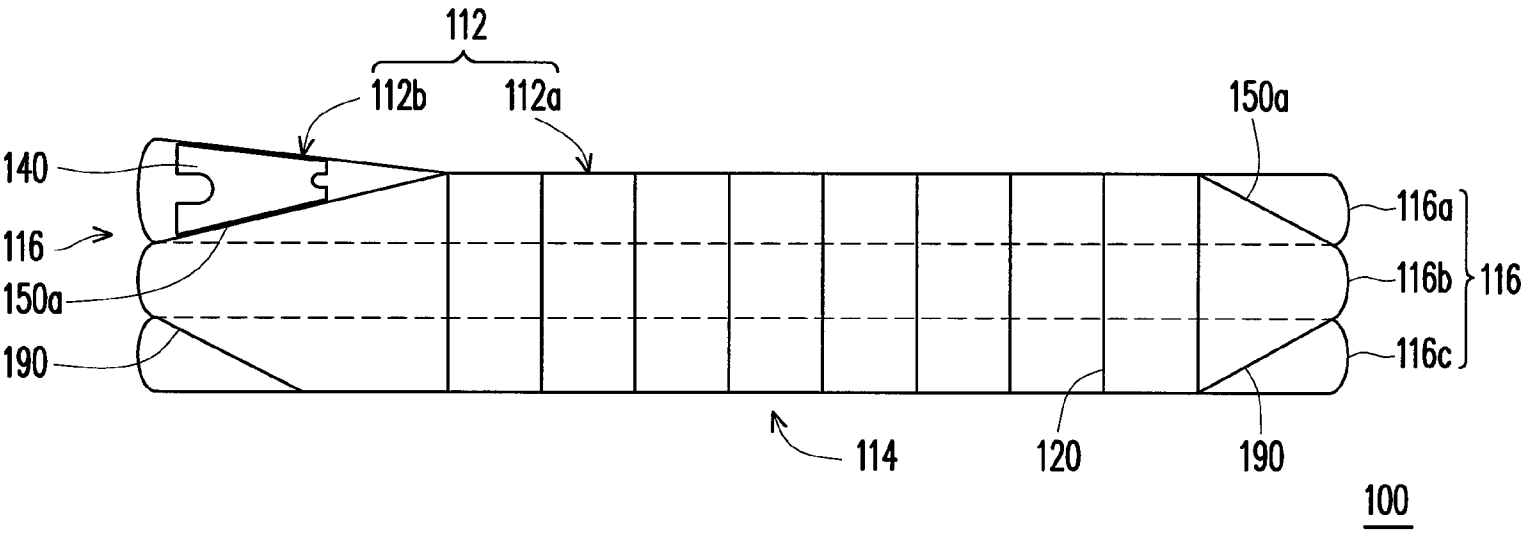
FIG. 8 is a cross-sectional view of an air mattress along the length direction according to another exemplary embodiment of the present invention.
Figure 9:
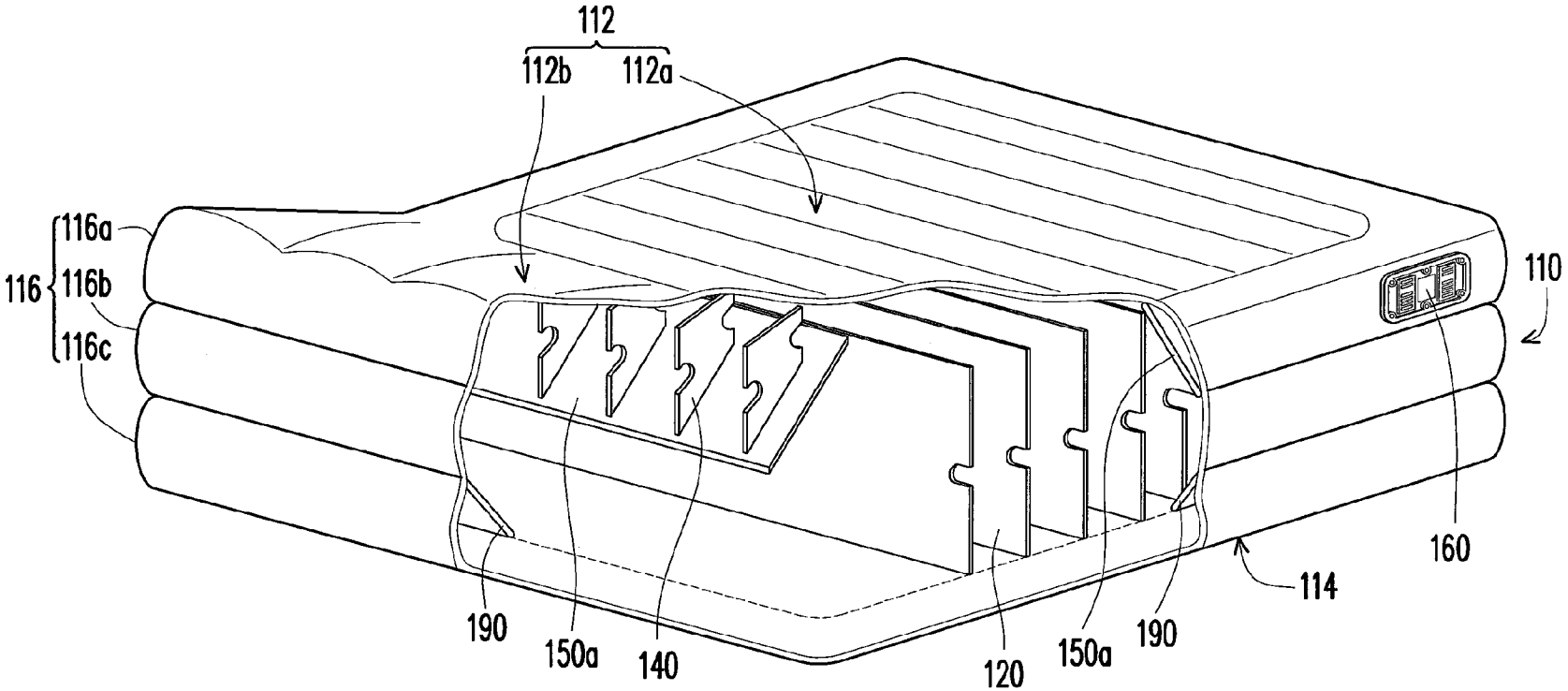
FIG. 9 is a schematic perspective view of the air mattress of FIG. 8.

FIG. 8 is a cross-sectional view of an air mattress along the length direction according to another exemplary embodiment of the present invention. FIG. 9 is a schematic perspective view of the air mattress of FIG. 8. Referring to FIG. 8 and FIG. 9, the air mattress 100 includes an inflatable compartment 110, a plurality of strips 120, a first peripheral strip 150*a*, a second peripheral strip 190 and a plurality of pillow strips 140, wherein the strips 120, the first peripheral strip 150*a*, the second peripheral strip 190 and the pillow strips 140 are air-pervious disposed in the inflatable compartment 110. The inflatable compartment 110 includes a top wall 112, a bottom wall 114 and a side wall 116 surrounding peripheries of the top wall 112 and the bottom wall 114. The top wall 112 includes a pillow portion 112*b* and a lying portion 112*a*. The strips 120 are arranged substantially parallel to the width direction of the air mattress 100 and respectively connected between the bottom wall 114 and the lying portion 112*a* of the top wall 112.

As mentioned above, the first peripheral strip 150*a* surrounds the strips 120 and incliningly connected between the side wall 116 and the top wall 112. The pillow strips 140 are arranged substantially parallel to the length direction of the air mattress 100 and directly connected between the first peripheral strip 150*a* and the pillow portion 112*b* of the top wall 112. The second peripheral 190 surrounds the strips 120 and incliningly connected between the side wall 116 and the bottom wall 114, wherein the position of the lower edge of the first peripheral strip 150*a* connected to the side wall 116 is higher than the position of the upper edge of the second peripheral strip 190 connected to the side wall 116, thus the side wall 116 is formed into a first layer portion 116*a*, a second layer portion 116*b* and a third layer portion 116*c*.

Similarly, the functions and shapes of the side wall 116, strips 120, pillow strips 140, first peripheral strip 150*a* and second peripheral strip 190 are similar or the same to the functions and shapes of the side wall, strips, pillow strips and peripheral strip of the air mattress of the embodiment shown in FIG. 7, thus the detailed description of the design can be referred to FIG. 7 and related FIG. 1, FIG. 2, FIG. 3 and FIG. 5A to FIG. 5E, and it is not repeated herein. However, it has to be noted that the height of the pillow strips 140 is smaller located relatively nearer to the connecting location of the first peripheral strip 150*a* and the top wall 112, since the lower edge of each of the strips 140 is directly connected on the first peripheral strip 150*a*.

In light of the above, comfort and convenience of the air mattress of the embodiment of present invention is increased because of the design of inner structure of pillow portion of the air mattress, wherein the top wall of the air mattress is formed with a lying portion and a pillow portion protruded from the lying portion due to the side wall designed with different heights. Accordingly, the user can pillow on the pillow portion of the top wall when lying on the air mattress and does not need to prepare any other pillow or something having pillow function. Furthermore, since pillow strips are added in the pillow portion, the surface of the pillow portion of the air mattress is comparatively smooth and it increases great comfort to the user.

Moreover, through the disposing of the at least one peripheral strip, the air mattress can easily form a side wall with multi-layered structure without necessary of stacking an extra mattress. Herein when more than one peripheral strip is used to respectively surround the side wall and connected to positions of different height, then the air mattress having the side wall with more-than-three-layered structure can easily be formed.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. An air mattress, comprising:

an inflatable compartment comprising a top wall, a bottom wall and a side wall surrounding peripheries of the top wall and the bottom wall;

a plurality of strips air-pervious and disposed in the inflatable compartment, wherein the strips are connected between the bottom wall and a lying portion of the top wall, and a top end and a bottom end of each of the strips are respectively connected to the top wall and the bottom wall, a length of the top end is greater than a length of the bottom end;

a connecting sheet air-pervious, disposed in the inflatable compartment and facing a pillow portion of the top wall, wherein the connecting sheet is connected between the side wall and the strips adjacent to the pillow portion; and a plurality of pillow strips air-pervious and disposed in the inflatable compartment, wherein the pillow strips are connected between the connecting sheet and the pillow portion of the top wall.

2. The air mattress as claimed in claim 1, further comprising a peripheral strip, wherein the peripheral strip is air-pervious, disposed in the inflatable compartment, surrounding the strips and connected between the bottom wall and the side wall, so that the side wall is formed into a first layer portion and a second layer portion.

3. The air mattress as claimed in claim 2, wherein the peripheral strip has a dragging portion and a reserved portion extending from an upper end of the dragging portion, a upper end of the dragging end and a lower end of the dragging end are respectively connected to the side wall and the bottom wall, and a portion of the reserved portion is connected to the connecting sheet.

4. The air mattress as claimed in claim 1, wherein a height of the side wall adjacent to the pillow portion of the top wall is greater than a height of the side wall adjacent to the lying portion of the top wall.

5. The air mattress as claimed in claim 1, wherein each of the strips has a recess at each side.

6. The air mattress as claimed in claim 1, wherein the connecting sheet has a recess at each side, and each of the pillow strips has a recess at each side.

7. The air mattress as claimed in claim 1, further comprising a first peripheral strip and a second peripheral strip, wherein the first peripheral strip and the second peripheral strip are air-pervious, disposed in the inflatable compartment, surrounding the strips and respectively connected between the bottom wall and the side wall, so that the side wall is formed into a first layer portion, a second layer portion and a third layer portion.

8. The air mattress as claimed in claim 7, wherein the first peripheral strip has a dragging portion and a reserved portion extending from an upper end of the dragging portion, a upper end of the dragging end and a lower end of the dragging end are respectively connected to the side wall and the bottom wall, and a portion of the reserved portion is connected to the connecting sheet.

9. The air mattress as claimed in claim 1, further comprising a reinforcing sheet, wherein the reinforcing sheet is disposed on the strip adjacent to the pillow portion and connected to the connecting sheet.

10. The air mattress as claimed in claim 1, further comprising an inflating device disposed on the side wall.

11. An air mattress, comprising:

an inflatable compartment comprising a top wall, a bottom wall and a side wall surrounding peripheries of the top wall and the bottom wall, wherein the top wall comprises a pillow portion and a lying portion;

a plurality of strips air-pervious and disposed in the inflatable compartment, wherein the strips are connected between the bottom wall and the lying portion of the top wall, and a top end and a bottom end of each of the strips are respectively connected to the top wall and the bottom wall, a length of the top end is greater than a length of the bottom end;

a peripheral strip air-pervious, disposed in the inflatable compartment and surrounding the strips and connected between the side wall and the top wall, so that the side wall is formed into a first layer portion and a second layer portion; and a plurality of pillow strips air-pervious and disposed in the inflatable compartment, wherein the pillow strips are connected between the peripheral strip and the pillow portion of the top wall.

12. The air mattress as claimed in claim 11, wherein a height of the side wall adjacent to the pillow portion of the top wall is greater than a height of the side wall adjacent to the lying portion of the top wall.

13. The air mattress as claimed in claim 11, wherein each of the strips has a recess at each side.

14. The air mattress as claimed in claim 11, wherein each of the pillow strips has a recess at each side.

15. The air mattress as claimed in claim 11, further comprising an inflating device disposed on the side wall.

16. An air mattress, comprising:

an inflatable compartment, comprising a top wall, a bottom wall and a side wall surrounding peripheries of the top wall and the bottom wall, wherein the top wall comprises a pillow portion and a lying portion;

a plurality of strips air-pervious and disposed in the inflatable compartment, wherein the strips are connected between the bottom wall and the lying portion of the top wall, and a top end and a bottom end of each of the strips are respectively connected to the top wall and the bottom wall, a length of the top end is greater than a length of the bottom end;

a first peripheral strip and a second peripheral strip air-pervious and disposed in the inflatable compartment, wherein the first peripheral strip surrounds the strips and respectively connected between the side wall and the top wall, and the second peripheral strip surrounds the strips and respectively connected between the side wall and the bottom wall, so that the side wall is formed into a first layer portion, a second layer portion and a third layer portion; and a plurality of pillow strips air-pervious and disposed in the inflatable compartment, wherein the pillow strips are connected between the peripheral strip and the pillow portion of the top wall.

17. The air mattress as claimed in claim 16, wherein a height of the side wall adjacent to the pillow portion of the top wall is greater than a height of the side wall adjacent to the lying portion of the top wall.

18. The air mattress as claimed in claim 16, wherein each of the strips has a recess at each side.

19. The air mattress as claimed in claim 16, wherein each of the pillow strips has a recess at each side.

20. The air mattress as claimed in claim 16, further comprising an inflating device disposed on the side wall.

* * * * *